US006877645B2

(12) United States Patent
Barker, III et al.

(10) Patent No.: US 6,877,645 B2
(45) Date of Patent: Apr. 12, 2005

(54) CONTAINER FOR DISPENSING COMESTIBLES

(75) Inventors: Edward E. Barker, III, Duluth, GA (US); Thomas L. Bussiere, Franklin, MA (US); Mark A. Dark, Blackstone, MA (US); Stephen C. Dunn, Natick, MA (US)

(73) Assignee: Six Continents Hotels, Inc., Atlanta, GA (US)

( * ) Notice: Subject to any disclaimer, the term of this patent is extended or adjusted under 35 U.S.C. 154(b) by 0 days.

(21) Appl. No.: 10/335,678

(22) Filed: Jan. 2, 2003

(65) Prior Publication Data

US 2004/0129740 A1 Jul. 8, 2004

(Under 37 CFR 1.47)

(51) Int. Cl.[7] ..... B67D 3/00
(52) U.S. Cl. ..... 222/467; 222/517; 222/556
(58) Field of Search ..... 222/465.1, 467, 222/517, 556

(56) References Cited

U.S. PATENT DOCUMENTS

| | | | | | |
|---|---|---|---|---|---|
| 1,877,636 | A | * | 9/1932 | Aronstam | 222/500 |
| 2,049,219 | A | * | 7/1936 | Muschinske et al. | 222/465.1 |
| 3,089,620 | A | * | 5/1963 | Green et al. | 222/89 |
| 3,217,929 | A | * | 11/1965 | Cole | 222/83.5 |
| 3,717,288 | A | * | 2/1973 | Schlegel | 222/465.1 |
| 3,933,271 | A | * | 1/1976 | McGhie | 220/838 |
| 4,046,108 | A | | 9/1977 | Balgemann et al. | |
| 4,151,910 | A | | 5/1979 | Yasur | |
| 4,158,427 | A | | 6/1979 | Hegge | |
| 4,562,941 | A | | 1/1986 | Sanfilippo | |
| 4,821,372 | A | * | 4/1989 | Casiello | 16/425 |
| 4,842,158 | A | | 6/1989 | Reyes, Jr. | |
| 4,948,012 | A | | 8/1990 | Snediker, Sr. et al. | |
| 5,054,657 | A | | 10/1991 | Morse et al. | |
| D336,826 | S | | 6/1993 | Crook | |
| 5,222,634 | A | | 6/1993 | Hayes | |
| 5,421,488 | A | * | 6/1995 | Ehrbar | 222/185.1 |
| 5,437,393 | A | | 8/1995 | Blicher et al. | |
| D397,940 | S | | 9/1998 | Safarian | |
| 5,826,754 | A | | 10/1998 | Ishaya et al. | |
| 5,918,769 | A | | 7/1999 | Capriglione | |
| 6,202,904 | B1 | | 3/2001 | Casciano | |
| 6,241,123 | B1 | | 6/2001 | Elmore | |
| 6,273,299 | B1 | | 8/2001 | Hernowitz et al. | |
| 6,318,605 | B1 | * | 11/2001 | Nyman et al. | 222/517 |
| 2002/0074367 | A1 | * | 6/2002 | Kawakita | 222/517 |

* cited by examiner

*Primary Examiner*—Joseph A. Kaufman
(74) *Attorney, Agent, or Firm*—Alston & Bird LLP

(57) ABSTRACT

A container for dispensing comestibles, such as a dry cereal dispenser, is provided that is generally designed to be capable of being fully cleaned and sanitized in order to avoid exposing the comestibles to contamination. In this regard, the various components of the container, such as the handle, the lid and the bottom closure, are advantageously mounted to the vessel such that the inner surface of the vessel with which the comestible is in contact is smooth and uninterrupted and, therefore, capable of being thoroughly cleaned. By including a removable bottom closure, the container may capable of being refilled through the bottom, opposite the open top through which the comestible is dispensed, to prevent stagnation of the comestible in lower portions of the container.

8 Claims, 4 Drawing Sheets

CONTAINER FOR DISPENSING COMESTIBLES

FIELD OF THE INVENTION

The present invention relates generally to containers for dispensing comestibles, such as dry cereal and other foodstuffs, and, more particularly, to containers for dispensing comestibles, such as single-serve or patron-serve containers, that include few, if any, sites at which contaminants can accumulate and which can be readily cleaned to thereby provide more sanitary and sterile conditions for the storage and dispensation of the comestibles.

BACKGROUND OF THE INVENTION

Containers for dispensing comestibles, such as dry cereal and other foodstuffs, are widely utilized. These containers are provided in a wide variety of shapes, sizes and designs and generally serve to store bulk quantities of a particular foodstuff. Individual portions of the foodstuff may then be dispensed from the container as desired. By providing bulk quantities of the foodstuff, the cost of each individual portion may be reduced somewhat relative to prepackaged individual servings of the same foodstuff. Additionally, by dispensing individual portions of a foodstuff from a container storing a bulk quantity of the foodstuff, the quantity of packaging that is generally discarded as waste is significantly reduced in comparison to the prepackaged individual servings of the same foodstuff.

One common example of a container for dispensing comestibles is a dry cereal dispenser. Dry cereal dispensers are employed in many settings including, for example, the breakfast bars provided by hotels to serve their patrons a complimentary breakfast on the morning after their overnight stay. These breakfast bars generally include a selection of foodstuffs, such as rolls, fruit and dry cereals, as well as a variety of juices, coffee, milk and other drinks. With respect to the dry cereal, although breakfast bars may include prepackaged individual servings, breakfast bars commonly include a dry cereal dispenser for dispensing individual servings of dry cereal from a bulk quantity stored by the dispenser for the reasons set forth above. In a typical example, a breakfast bar includes several dry cereal dispensers with each dispenser containing a different type of dry cereal. These dry cereal dispensers may be freestanding or may be housed in a carousel.

One conventional dry cereal dispenser includes an upstanding vessel having a handle and a hinged lid covering the otherwise open top of the vessel. By opening the lid and tipping the dispenser, dry cereal may be poured into a bowl. This type of dry cereal dispenser is generally effective for dispensing dry cereal. In this regard, the dry cereal dispenser generally handles relatively well and permits dry cereal to be poured from the dispenser relatively easily. However, this type of dispenser has several shortcomings. In particular, this type of dry cereal dispenser is difficult, if not impossible, to sanitize; therefore undesirably subjecting the dry cereal to contaminants. This conventional type of cereal dispenser generally has several features that are difficult, if not impossible, to clean that serve as sites at which contaminants accumulate.

For example, the handle is generally connected to the vessel by means of two or more fasteners that extend from within the vessel through the sidewall of the vessel and into the handle. As such, the heads of the fasteners are exposed within the vessel and are difficult, if not impossible, to sanitize. Similarly, the lid is commonly connected to the vessel by a hinge. The hinge, in turn, is generally connected to both the lid and the vessel by means of fasteners, some of which extend through the lid and some of which extend through the sidewall of the vessel. The heads of these fasteners are also difficult, if not impossible, to sanitize. These exposed fasteners therefore serve as sites for the accumulation of contamination within the vessel. Furthermore, this type of dry cereal dispenser generally has a sealed bottom. In many instances, the bottom of the dispenser intersects the sidewalls of the vessel to form a corner that may either define a right angle or be radiused, albeit with a relatively small radius. In these instances, the corner between the sidewalls and the bottom of the vessel is also difficult, if not impossible, to sanitize and serves as yet an additional site for contamination. As will be apparent, the exposure of virtually any comestible, including dry cereal, to contaminants is undesirable.

The manner in which this type of dry cereal dispenser is refilled may also pose a problem. In this regard, the dry cereal dispenser is refilled by opening the lid and pouring additional dry cereal into the vessel through the open top. While this method of refilling is adequate in instances in which the vessel has been emptied prior to being refilled, dry cereal dispensers of this type are sometimes refilled with fresh cereal while older cereal remains in the lower portions of the vessel. If this practice of refilling is repeated, the upper portions of the dry cereal dispenser may include fresh cereal, but older and, in some instances, undesirable cereal may stagnate in the lower portions of the vessel.

In addition to the upstanding dispenser that permits dry cereal or other comestibles to be poured from an open top, other dispensers have been developed. For example, U.S. Pat. No. 5,918,769 to Carmine J. Capriglione describes a cereal dispenser having a cylindrical receptacle that is divided into three substantially equally sized compartments for storing and dispensing different cereals. The lower portion of each compartment defines an outlet covered by a hinged flap such that cereal may be dispensed by opening a respective flap. In addition to the dispenser described by U.S. Pat. No. 5,918,769, other dispensers that dispense cereal from an outlet defined by a lower portion of the dispenser have been developed.

A more complex dispenser is described by U.S. Pat. No. 5,826,754 to Romeo M. Ishaya, et al. This dispenser includes a storage bin for storing the cereal, a dispenser proximate lower portions of the storage bin for receiving cereal from the storage bin and for controllably dispensing the cereal, and a stand for supporting the dispenser and the storage bin. More specifically, the dispenser includes an auger that may be rotated in order to discharge cereal through a discharge opening and into a bowl. The auger is disposed in the passage leading from the storage bin to the discharge opening and controls the quantity of cereal dispensed into the bowl. As will be apparent from its relatively complex design, this dispenser may also be somewhat difficult, if not impossible, to completely sanitize and therefore may expose the cereal or other comestibles to contamination. Additionally, this more complex dispenser is generally more expensive than the dispensers comprised of an upstanding vessel from which the dry cereal or other comestibles may be poured.

As such, it would be desirable to develop a container for dispensing comestibles, such as dry cereal, that can be completely sanitized so as to prevent exposure of the comestibles to contamination. Additionally, it would be desirable to develop a sanitizable container for dispensing comestibles that is relatively inexpensive and is intuitive to both use and to clean.

BRIEF SUMMARY OF THE INVENTION

A container for dispensing comestibles, such as a dry cereal dispenser, is therefore provided according to the present invention that is generally designed to be capable of being fully cleaned and sanitized in order to avoid exposing the comestibles to contamination. In this regard, the various components of the container, such as the handle, the lid and the bottom closure, are advantageously mounted to the vessel such that the inner surface of the vessel with which the comestible is in contact is smooth and uninterrupted and, therefore, capable of being thoroughly cleaned. Additionally, the container of at least one embodiment that includes a removable bottom closure is capable of being refilled through the bottom, opposite the open top through which the comestible is dispensed, to prevent stagnation of the comestible in lower portions of the container.

According to the present invention, a container for dispensing comestibles, such as a dry cereal dispenser, is provided that includes a vessel defining an outlet through which the comestibles are dispensed. The vessel may be upstanding so as to define an open upper end that serves as the outlet through which the comestibles are dispensed and an opposed lower end. The vessel also generally includes opposed inner and exterior surfaces.

According to one aspect of the present invention, the container includes a handle that a user may grasp in order to pour the comestible from the outlet defined by the vessel. The handle is mounted to the exterior surface of the vessel. In one embodiment, the handle includes a handle portion and at least one spring member that extends at least partially about the vessel. The handle of this embodiment may be slidably mounted upon the vessel with the spring member being sized smaller than the vessel such that the spring member is caused to expand as the handle is slidably mounted upon the vessel. As such, the spring member engages the vessel and secures the handle thereto.

In one embodiment, the handle includes first and second spring members interconnected by the handle portion. In this embodiment, each spring member extends at least partially about the vessel. In addition, the first and second spring members are advantageously spaced apart along the exterior surface of the vessel with the handle portion therebetween. To facilitate fabrication of the handle, the first and second spring members and the handle portion may be a contiguous integral structure, such as a rod of spring steel bent to define the first and second spring members and the handle portion therebetween.

In embodiments in which the upstanding vessel defines an open lower end opposite the open upper end that serves as the outlet through which the comestibles are dispensed, the container may also include a removable closure for sealing the lower end of the vessel. The closure is capable of securely engaging the vessel, such as by means of mechanical engagement therewith, to seal the lower end of the vessel. The closure is also capable of being removed to permit access to the interior of the vessel via the open lower end. As such, the closure may be removed in order to clean and/or refill the container. By permitting refilling of the container through the open lower end opposite the outlet through which the comestibles are dispensed, the container of this embodiment avoids the accumulation of stagnant foodstuffs in the lower portion of the container.

The closure may include an insert that is removably disposed within the lower end of the vessel. In this embodiment, the closure can also include a spring for securely engaging the insert within the lower end of the vessel. Moreover, opposite ends of the spring may extend through respective openings defined by the insert and the lower end of the vessel in order to mechanically engage the closure to the vessel.

According to another aspect of the present invention, the container includes a lid for covering the outlet defined by the vessel and a hinge assembly connecting the lid to the vessel. The hinge assembly permits the lid to be moved between a closed position in which the lid covers the outlet and an open position in which the lid is at least partially displaced from the outlet to permit comestibles to be dispensed. According to this aspect of the present invention, the hinge assembly connects the lid to the vessel in a manner independent of the inner surface of the vessel. Thus, the hinge assembly may connect the lid to the vessel, such as to the exterior surface of the vessel, without requiring fasteners to extend through the inner surface of the vessel, thereby eliminating a potential site for contamination.

The hinge assembly may include a tab extending outwardly from the lid and a spring that engages both the tab and the vessel. As a result of its construction, the hinge assembly defines a threshold angle between the lid and an end of the vessel that defines the outlet such that the lid will move to a fully open position if the lid is positioned at an angle greater than the threshold angle, but will return to a fully closed position if the lid is positioned at an angle less than the threshold angle. Thus, the lid cannot be inadvertently left open, thereby further limiting the possibility of contamination of the foodstuffs.

According to the present invention, a container, such as a dry cereal dispenser, is therefore provided that has few, if any, sites at which contaminants can accumulate and that can be readily sanitized. In this regard, a dry cereal dispenser having both a handle and a hingedly connected lid is provided according to one embodiment of the present invention that is designed such that the inner surface of the vessel is uninterrupted and smooth. To avoid interrupting the inner surface of the vessel, the handle and the lid may be mounted to the vessel without requiring fasteners to extend through the inner surface of the vessel, thereby eliminating a site for contamination that was difficult, if not impossible, to sanitize. As described above, the sanitization of the dry cereal dispenser of this embodiment may also be facilitated by advantageously including a removable closure for sealing the lower end of a vessel, while remaining capable of being removed to permit cleaning and/or refilling of the vessel.

BRIEF DESCRIPTION OF THE DRAWINGS

Figure 1:
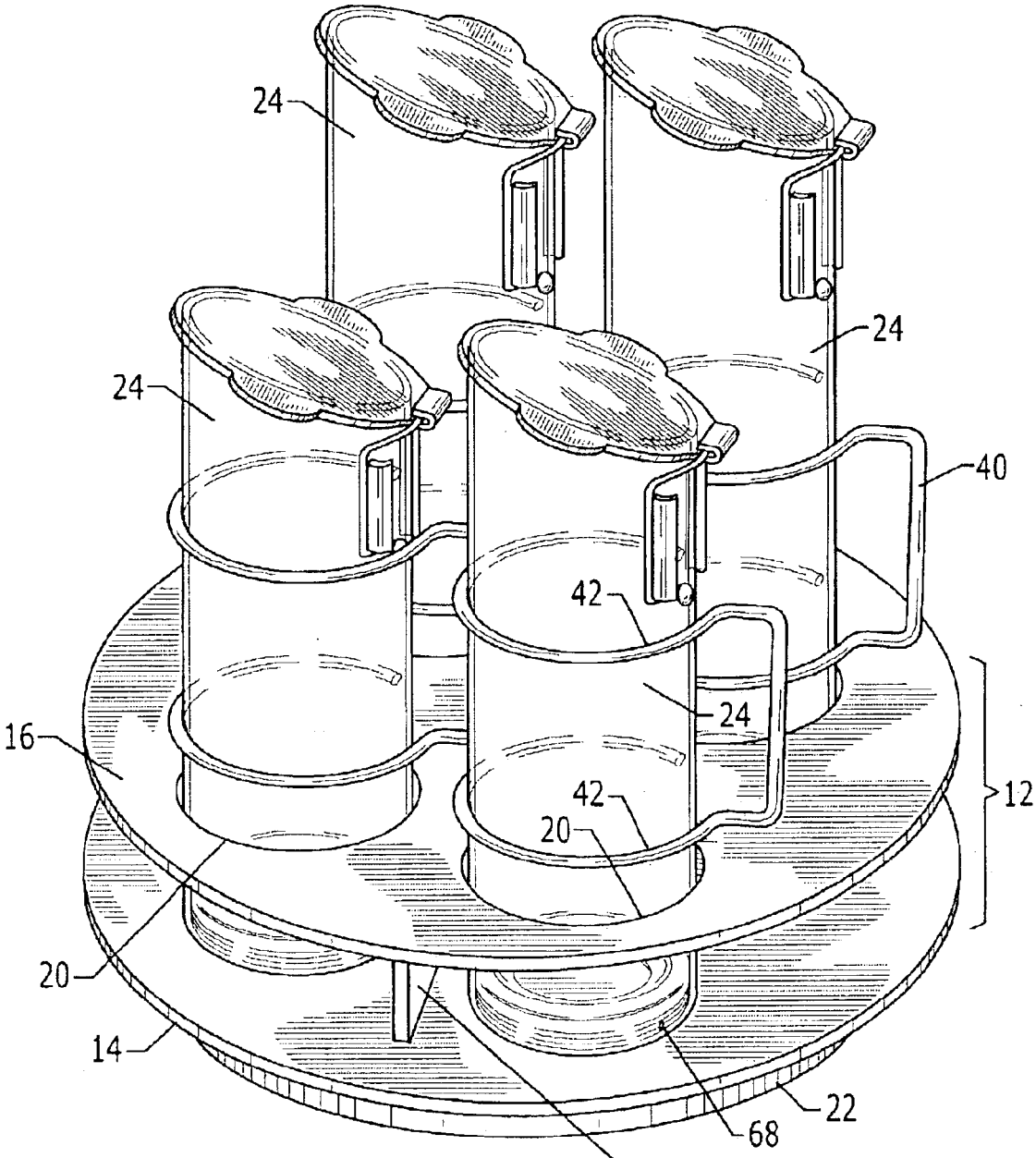
Figure 2:
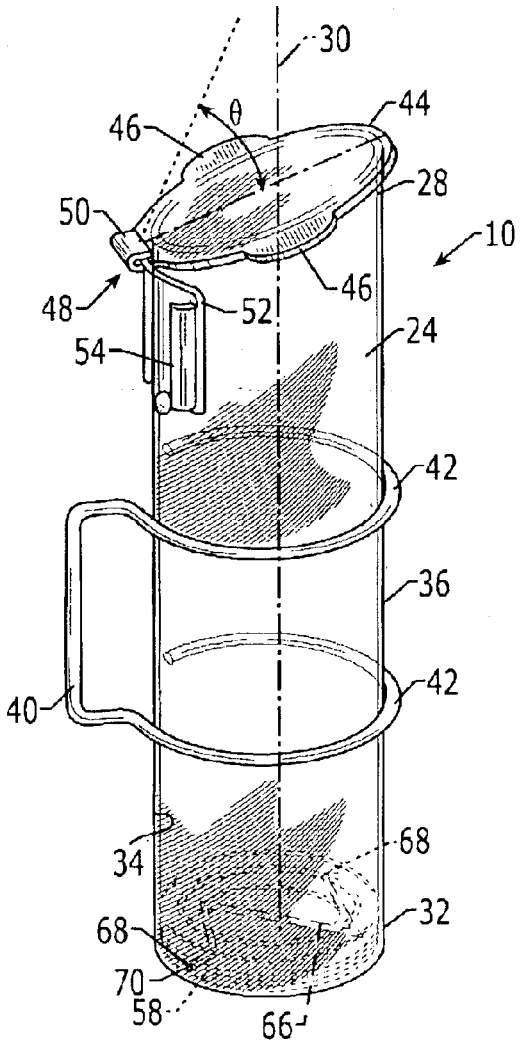
Figure 3:
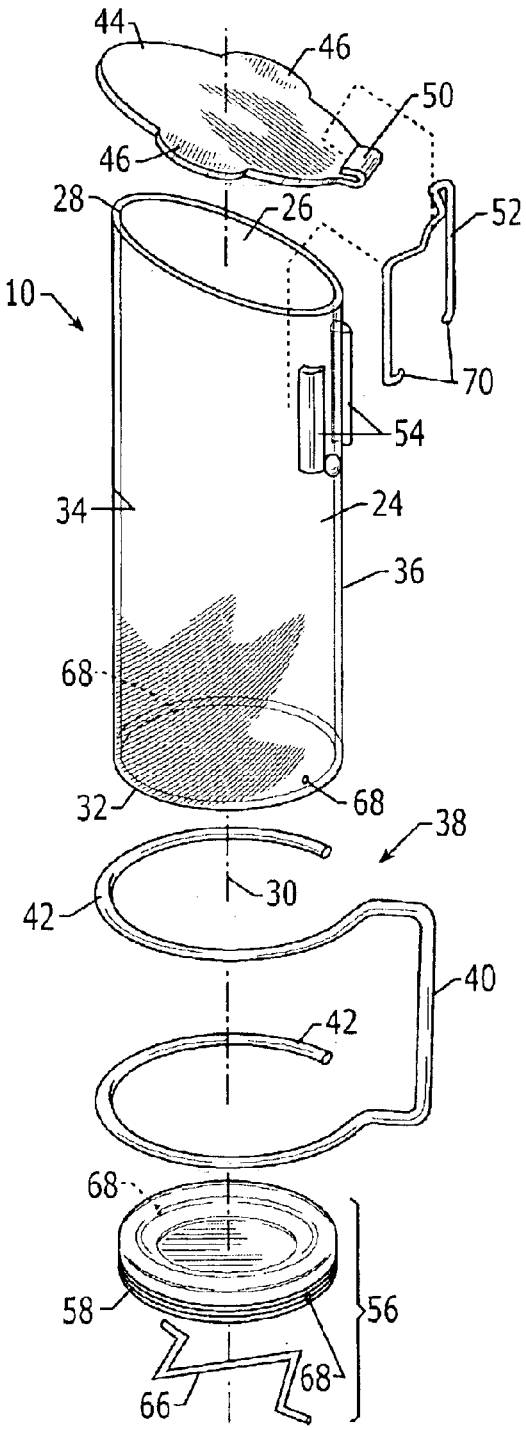
Figure 4:
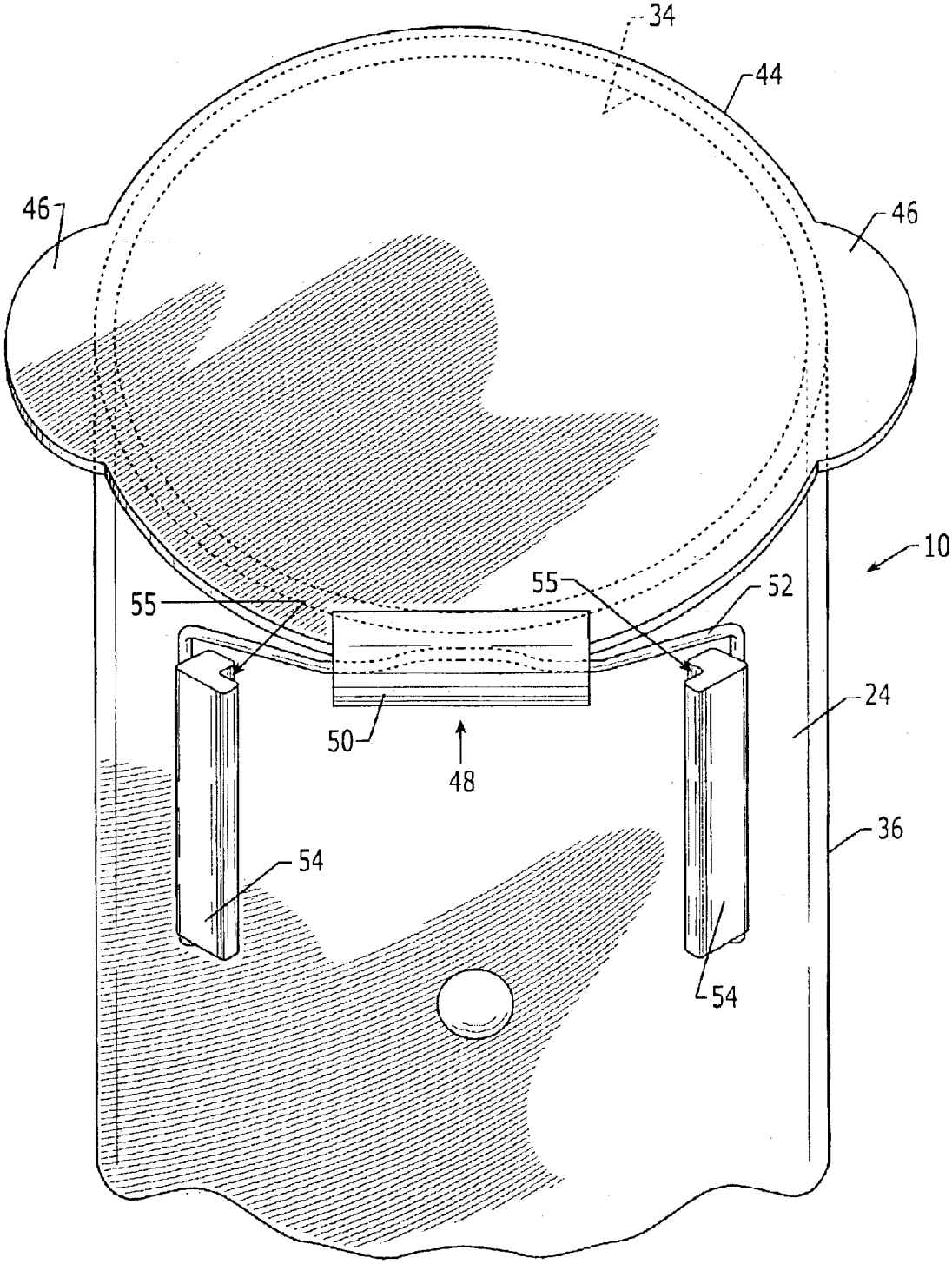
Figure 5:
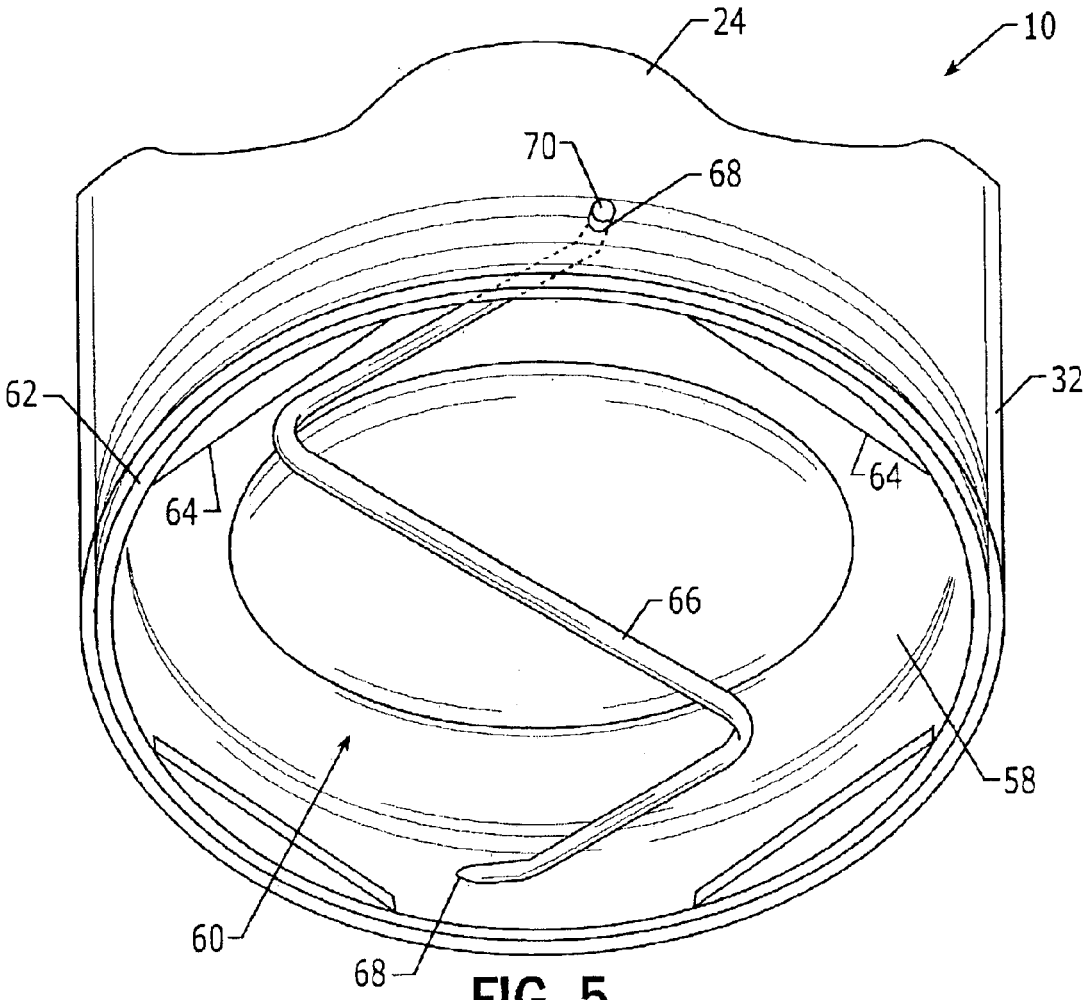

Having thus described the invention in general terms, reference will now be made to the accompanying drawings, which are not necessarily drawn to scale, and wherein:

FIG. 1 is a perspective view of a carousel including four containers according to one embodiment of the present invention;

FIG. 2 is a perspective view of a container according to one embodiment of the present invention;

FIG. 3 is an exploded perspective view of the container of FIG. 2;

FIG. 4 is a more detailed perspective view of the lid, hinge assembly and upper portion of the upstanding vessel of the container of FIG. 2; and FIG. 5 is a more detailed perspective view of a removable closure disposed within a lower end of the vessel of the container of FIG. 2.

DETAILED DESCRIPTION OF THE PREFERRED EMBODIMENTS

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

As shown in FIGS. 1 and 2, a container 10 for dispensing comestibles is provided in accordance with the present invention. The container may dispense a variety of comestibles including, for example, dry cereal and other foodstuffs. Although the container may be utilized individually, a group of containers is oftentimes provided for dispensing different comestibles or different types of the same comestible. For example, FIG. 1 depicts a group of four containers, such as four dry cereal dispensers for dispensing different types of dry cereal. Although the containers within a group of containers may be sized and shaped differently, the containers generally have the same general shape and differ only in height. In this regard, each container of a group may have a different height than the other containers in the group to assist a patron in identifying the desired container and to provide an aesthetically pleasing arrangement.

Although the containers 10 are generally designed to be freestanding, the group of containers may be disposed within a carousel 12, if so desired. The carousel provides additional support for the containers to reduce the possibility that the containers will be inadvertently knocked over. In addition, the carousel provides for a relatively compact and aesthetically pleasing arrangement of the group of containers. While the carousel may be configured in various fashions, the carousel of the illustrated embodiment includes a base 14 and a support member 16 spaced apart from the base by means of a stem 18. The support member defines a plurality of openings 20, equal in number to the number of containers. In the illustrated embodiment, for example, the support member defines four openings for receiving and holding four containers. Each opening is sized to approximate the size of the respective container such that the containers snugly fits within the respective openings and are securely held in an upright position. If desired, the carousel may also include a turntable 22 to support the base and permit rotational movement of the base, the support member and the containers carried thereby relative to the surface upon which the carousel sits. As such, the carousel can be rotated until the desired container is accessible so as to be easily grasped and lifted from the respective opening defined by the support member.

As shown in more detail in FIG. 2, the container 10 of the present invention includes a vessel 24, such as an upstanding vessel. In the illustrated embodiment, the vessel has a generally cylindrical shape, although the vessel may have other shapes, if so desired. The vessel may be formed of various materials, but, in one embodiment, is formed of a plastic, such as acrylic. Although not necessary to the present invention, the container is typically transparent or translucent such that a patron can view the contents of the container which may assist the patron in making their selection.

The vessel 24 defines an outlet 26 through which the comestibles are dispensed. In the illustrated embodiment, for example, the upstanding vessel defines an open upper end 28 that serves as the outlet. As shown, the upper end of the upstanding vessel of the illustrated embodiment is disposed at an angle, such as 30°, relative to a reference plane perpendicular to the centerline 30 of the vessel. By being angled, the upper end facilitates pouring the comestibles from the vessel and functions somewhat as a spout. However, the upper end may be perpendicular to the centerline of the vessel or may be disposed at any other angle relative to the centerline, if so desired.

The vessel 24 also includes a lower end 32, opposite the open upper end 28. As described below, the lower end is also preferably open to facilitate the cleaning of the vessel. As shown, the lower end is generally orthogonal to the centerline 30 defined by the vessel such that the container can sit upright in an unsupported manner upon a counter or the like. However, the lower end may be disposed at other angles relative to the centerline defined by the vessel, if so desired.

The vessel 24 includes opposed inner and exterior surfaces 34, 36. As also described below, the inner surface of the vessel is advantageously an uninterrupted, smooth surface. As used herein, an uninterrupted, smooth surface refers to a surface that is continuous, that is not interrupted by fasteners or the like extending therethrough, and that has no sharp corners, i.e., no corners that define right angles or are radiused with a relatively small radii of curvature that renders the corner difficult, if not impossible, to be adequately cleaned. For example, the National Sanitation Foundation of Ann Arbor, Mich. has promulgated standards indicating that containers have radiused corners with a radius of curvature of less than ⅛ inch cannot generally be adequately sanitized. By providing a vessel advantageously having an uninterrupted, smooth surface, the vessel of the present invention and, in particular, the inner surface of the vessel may be thoroughly cleaned in a reliable and repeatable manner.

As also shown in FIG. 2, the container 10 advantageously includes a handle 38 mounted upon the exterior surface 36 of the vessel 24. The handle includes a handle portion 40 that may be grasped by a patron. As such, the handle portion is sized to be readily grasped by hands that are both large and small. The handle also includes at least one spring member 42 that extends at least partially about the vessel. In this regard, the spring member extends circumferentially about a majority of the vessel, i.e., circumferentially about more than 50% of the vessel. The spring member does not generally form a closed loop, but, instead, defines an opening to facilitate flexation of the spring member as described below. As such, the spring member typically extends circumferentially about 70% to 95% of the vessel and, more commonly, about 88% of the vessel.

The spring member 42 is sized to engage the vessel 24 to thereby mount the handle 38 to the exterior surface 36 of the vessel without requiring fasteners. By permitting the handle to be mounted without requiring fasteners, fasteners will not extend through the inner surface 34 of the vessel, thereby avoiding the creation of any sites at which contaminants would typically accumulate. As shown in FIG. 3, the handle is advantageously slidably mounted upon the vessel with the spring member extending thereabout. In order to permit the spring member to engage the vessel, the spring member is sized to be smaller than the vessel. In this regard, the spring member generally has a nominal size slightly smaller than the vessel, such as about ⅛ inch smaller for a vessel having an exterior diameter of 4¼ inches. The spring member is also advantageously formed of a material that permits the spring member to expand as the handle is slidably mounted upon the vessel. For example, the spring member may be formed of spring steel or other similar materials. Thus, the handle may be slid along the vessel to the desired position. Since the handle is capable of being slidably mounted upon the vessel, the same handle may be utilized in conjunction with vessels having different heights, such as those shown in FIG. 1, so long as the vessels otherwise have the same shape and size. As a result of the expansion of the spring member and the tendency of the spring member to return to its nominal position, the spring member securely engages the exterior surface of the vessel, thereby retaining the handle in the desired position upon the vessel.

In one advantageous embodiment, the handle 38 includes first and second spring members 42 interconnected by the handle portion 40. While the spring members may be sized somewhat differently, the spring members of one advantageous embodiment have the same size and extend circumferentially about the same percentage of the vessel 24. As shown, the first and second spring members are spaced apart along the exterior surface 36 of the vessel with the handle portion therebetween. To facilitate fabrication of the handle, the first and second spring members and the handle portion may be a continuous integral structure. For example, the entire handle including the first and second spring members and the handle portion may be formed of a rod, such as a rod of spring steel, that is bent to define the first and second spring members with the handle portion therebetween.

As shown in FIG. 2, the container 10 also generally includes a lid 44 for covering the outlet 26 defined by the vessel 24. The lid is generally slightly larger than the outlet such that the lid completely covers the outlet. In addition, the lid may have one or more tabs 46 extending outward to provide convenient features for a patron to grasp in order to open or close the lid. In the illustrated embodiment, for example, the lid includes a pair of tabs extending outwardly from opposite sides of the lid. The lid may be formed of various materials. Although the lid may be formed of the same material as the vessel, the lid of one embodiment is formed of a plastic such as a polyethleneterephtalate glycol (PET-G) copolyester sheet. Additionally, while the lid may be opaque, the lid is also typically transparent or translucent in order to permit the patron to view the contents of the container.

According to this aspect of the present invention, the container 10 also advantageously includes a hinge assembly 48 connecting the lid 44 to the vessel 24. The hinge assembly permits the lid to be moved between a closed position in which the lid covers the outlet 26 and an open position in which the lid is at least partially displaced from the outlet. In the open position, comestibles may be dispensed, such as by being poured from the outlet.

According to this aspect of the present invention, the hinge assembly 48 connects the lid 44 to the vessel 24 and, in particular, to the exterior surface 36 of the vessel in a manner independent of the inner surface 34 of the vessel. In this regard, the hinge assembly connects the lid to the vessel without requiring fasteners to extend through the inner surface of the vessel, thereby eliminating additional sites at which contamination could otherwise accumulate. Although the hinge assembly may be formed in various manners, the hinge assembly of one advantageous embodiment is depicted in more detail in FIGS. 3 and 4. The hinge assembly of this embodiment includes a tab 50 extending outwardly from the lid. The tab is bent so as to have a generally U-shape. While the tab may be formed in various manners, the tab may be formed integral with the lid so as to extend outwardly therefrom in a common plane. For a lid, and, in turn, a tab formed of a plastic, such as PET-G, a portion of the tab may then be heated, such as by means of a hot wire or the like, and bent through an angle of about 180° to define the U-shaped structure depicted in the illustrated embodiment.

The hinge assembly 48 of this embodiment also includes a spring 52 that engages both the tab 50 and the vessel 24 and, more commonly, the exterior surface 36 of the vessel. While the spring may engage various portions of the vessel, the container 10 of one advantageous embodiment takes advantage of the ticket strip mounts 54 to also anchor the spring. In this regard, the container may include a pair of ticket strip mounts spaced circumferentially about the exterior surface of the vessel that define respective slots 55 for capturing the opposed edges of a label. A label designating the contents of the container, such as corn flakes, bran flakes or the like, may therefore be inserted within and held by the ticket strip mounts. To retain a label within the ticket strip mounts, the container may also include a bead, bump or other protrusion as depicted in the drawings, positioned between the ticket strip mounts in general alignment with a lower end thereof in order to support the label. In order to anchor the spring to the vessel, opposed ends of the spring may extend downwardly along the ticket strip mounts, such as along the outwardly facing sides of the ticket strip mounts (relative to a label held therebetween), with the opposed ends of the spring bent around the lowermost portions of the ticket strip mounts. The intermediate portion of the spring is then bent outwardly somewhat relative to the vessel so as to extend about the vessel and through the U-shaped tab. The portion of the spring that extends through the tab is preferably snugly received within the passage defined by the U-shaped tab. As in the illustrated embodiment, for example, the portion of the spring that extends through the tab may be bent somewhat in order to ensure that the intermediate portion of the spring is snugly retained within the passage defined by the U-shaped tab.

Although the spring 52 may be formed of various materials, the spring may also be formed of spring steel. Additionally, the spring is generally formed to have a nominal shape and size that requires the spring to be bent or expanded somewhat in order to be positioned along the outwardly facing sides of the ticket strip mounts 54 and to extend through the U-shaped passage defined by the tab 50. As such, the spring grasps the ticket strip mounts in order to securely mount the lid 44 to the vessel 24.

The hinge assembly 48 may advantageously define a threshold angle 0 between the lid 44 and the upper end 28 of the vessel 24 that defines the outlet 26. As such, if the lid is positioned at an angle greater than the threshold angle, the hinge assembly and, in particular, the spring 52 will move the lid to a fully open position and will retain the lid in the fully open position until a force is applied to the lid to return the lid to a closed position. Alternatively, if the lid is positioned in a partially opened position at an angle less than the threshold angle, the hinge assembly will return the lid to a fully closed position in the absence of a patron continuing to hold the lid open. Thus, a patron may hold the lid in a partially open position to pour foodstuffs from the container 10, but in the absence of the patron continuing to hold the lid open, the lid will close to eliminate entry of airborne contaminants into the container. The threshold angle may be controllably varied depending upon the design of the spring, the dimensions of the tab 50 and the like. However, the threshold angle of one advantageous embodiment of the container is about 65°.

As mentioned above, the vessel 24 may also have an open lower end 32, opposite the upper end 28 that services as the outlet 26. In this embodiment, the container 10 also includes a removable closure 56 for sealing, the lower end of the vessel. The closure is capable of securely engaging the vessel, such as by means of mechanical engagement therewith, to seal the lower end of the vessel such as in instances in which comestibles, such as dry cereal, are stored within the container and the container is being utilized to dispense the comestibles. However, the closure is also capable of being removed to permit access to the interior of the vessel via the open lower end. By removing the closure, the interior of the vessel may be cleaned, thereby avoiding the accumulation of contaminants, such as in the corner or pocket at the intersection between the sidewalls of the vessel and the bottom of the vessel as in some conventional dispensers. Additionally, the container may be refilled through the open lower end. As such, the comestible, such as dry cereal, may be dispensed through the open upper end of the vessel and filled through the open lower end of the vessel, thereby preventing stagnation of any foodstuff in lower portions of the vessel as could occur in some conventional dispensers.

The removable closure 56 may be constructed in various manners. For example, the closure may be a cap, such as a cap formed of a plastic, such as polyethylene or the like, that fits about the lower end 32 of the vessel 24. In this embodiment, the vessel could include one or more outwardly extending posts and the cap could include one or more corresponding L-shaped slots that extend downwardly from an upper edge of the cap and then circumferentially thereabout. The cap may therefore be positioned upon the lower end of the vessel and then rotated relative to the vessel such that the posts move through the respective slots and are engaged therein so as to securely mount the cap upon the lower end of the vessel.

Alternatively, the closure 56 could include an insert that is removably disposed within the lower end 32 of the vessel 24. For example, the insert could include an outwardly facing threaded portion and the inner surface 34 of the vessel proximate the lower end could include a complimentary threaded portion such that the insert could be threadably engaged to the vessel. In this embodiment, the threads defined by the inner surface of the vessel would be completely engaged by the corresponding threaded portion of the insert and would not extend beyond the insert into the cavity defined by the vessel.

Alternatively and as shown in FIGS. 3 and 5 in more detail, the removable closure 56 of one advantageous embodiment includes an insert 58 that is engaged within the open lower end 32 of the vessel 24 in another manner. In this regard, the closure may be sized to fit snugly within the open lower end of the vessel to define the floor or bottom of the container 10. As shown, the insert is advantageously recessed so as to define a pocket 60 extending upwardly into the vessel. The insert may include an outwardly extending lip 62 for engaging the end of the vessel and for limiting the insertion of the closure therein. Still further, the closure may optionally include one or more tabs 64 that may be grasped to facilitate the insertion and removal of the closure within the lower end of the vessel.

In the illustrated embodiment, the closure 56 also includes a spring 66, typically disposed within the pocket 60 defined by the insert 58, for securely retaining the insert within the lower end 32 of the vessel 24. In this regard, the spring may be formed by spring steel or another material exhibiting similar spring-like behavior that is bent so as to exert an outwardly directed force upon the insert, thereby forcing the insert outwardly into more secure engagement with the vessel. Additionally, the insert and the vessel may define respective openings 68 such that the opposite ends 70 of the spring may extend into and engage corresponding pairs of the aligned openings, thereby mechanically engaging the closure to the vessel.

The container 10 of the present invention therefore may include several features that facilitate the cleaning and sanitization of the vessel 24 and the elimination of sites at which contamination could otherwise accumulate. In this regard, the container is designed such that the inner surface 34 of the vessel is smooth and uninterrupted, thereby avoiding the use of fasteners that extend through the inner surface of conventional dispensers and provide sites for the accumulation of contamination. Additionally, the container may include a removable closure 56 to facilitate cleaning of the vessel, thereby also avoiding the accumulation of contamination in the corner between the sidewalls and the bottom of a conventional vessel. In addition, the removable closure facilitates filling of the container through the open lower end 32 so as avoid problems associated with the stagnation of foodstuffs in the lower portion of some conventional dispensers.

As described above, the container 10 is advantageous for the dispensation of a variety of comestibles. However, the container is particularly advantageous for dispensing dry cereal. As such, the container may be employed on breakfast bars operated by hotels or the like to permit the patrons to easily pour cereal into their bowls, while at the same time permitting the hotel staff to readily clean and refill the container.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A container for dispensing comestibles comprising:

an upstanding vessel defining an open upper end that serves as an outlet through which the comestibles are dispensed and an opposed open lower end; and a removable closure for sealing the lower end of said vessel, said closure capable of securely engaging said vessel to seal the lower end of said vessel and also capable of being removed to permit access to an interior of said vessel via the open lower end, wherein said closure comprises an insert removably disposed within the lower end of said vessel and a spring for securely engaging said insert within the lower end of said vessel.

2. A container according to claim 1 wherein said closure is mechanically engaged to said vessel.

3. A container according to claim 1 wherein opposite ends of said spring extend through respective openings defined by said insert and the lower end of said vessel.

4. A container for dispensing comestibles comprising:

a vessel defining an outlet through which the comestibles are dispensed, said vessel including opposed inner and exterior surfaces;

a lid for covering the outlet defined by said vessel; and a hinge assembly connecting said lid to said vessel such that said lid is capable of being moved between a closed position in which said lid covers the outlet and an open position in which the lid is at least partially displaced from the outlet to permit comestibles to be dispensed, said hinge assembly connecting said lid to said vessel in a manner independent of the inner surface of said vessel, wherein said hinge assembly comprises a tab extending outwardly from said lid and a spring that directly engages both said tab and said vessel to assist in moving said lid between oven and closed positions.

5. A container according to claim 4 wherein said hinge assembly connects said lid to the exterior surface of said vessel.

6. A container according to claim 4 wherein said hinge assembly connects said lid to said vessel without requiring fasteners to extend through the inner surface of said vessel.

7. A container according to claim 4 wherein said vessel comprises a mount on an exterior surface thereof, and wherein said spring engages said mount.

8. A container according to claim 4 wherein said hinge assembly defines a threshold angle between said lid and an end of said vessel that defines the outlet such that said lid will move to a fully open position if positioned at an angle greater than the threshold angle and will return to a fully closed position if positioned at an angle less than the threshold angle.

* * * * *